United States Patent [19]

Calvert et al.

[11] 4,213,283

[45] Jul. 22, 1980

[54] MACHINE FOR APPLYING AN ARTICLE CARRIER TO A PLURALITY OF BOTTLES

[75] Inventors: Rodney K. Calvert, Dunwoody; Dale K. Scott, Jonesboro; Alton J. Fishback, Austell, all of Ga.

[73] Assignee: The Mead Corporation, Dayton, Ohio

[21] Appl. No.: 960,736

[22] Filed: Nov. 15, 1978

[51] Int. Cl.[3] ..... B65B 21/00

[52] U.S. Cl. ..... 53/48

[58] Field of Search ..... 53/398, 48, 134, 413, 53/458, 446

[56] References Cited

U.S. PATENT DOCUMENTS

| | | | |
|---|---|---|---|
| 2,766,567 | 10/1956 | Fahrenbach et al. | 53/48 X |
| 2,953,883 | 9/1960 | Gentry | 53/48 X |
| 3,303,631 | 2/1967 | Ganz | 53/48 |

*Primary Examiner*—Horace M. Culver

*Attorney, Agent, or Firm*—Walter M. Rodgers; Walter A. Rodgers

[57] ABSTRACT

A machine for applying an article carrier (C) having apertures (19,23,24) therein to a plurality of bottles to cause the neck of each bottle to be enveloped by a carrier aperture includes conveyor means (4) for moving a group of bottles arranged in side by side relationship and in at least one row into a loading station, vertically reciprocable plunger means (55,59) disposed above the loading station, at least one applicator member (60) pivotally mounted on said plunger means (55,59), a carrier feeder arm (61) pivotally mounted on the plunger means and arranged to engage and withdraw a carrier from a stationary hopper (10) and to deposit the carrier in said applicator member (60) so that downward movement of said plunger means causes the carrier apertures to envelope the necks of bottles disposed at said loading station together with cam means (80,81) arranged to swing said applicator member about its pivotal mounting following application of a carrier to a group of bottles so as to cause said applicator member to disengage the carrier.

15 Claims, 11 Drawing Figures

Fig. 1
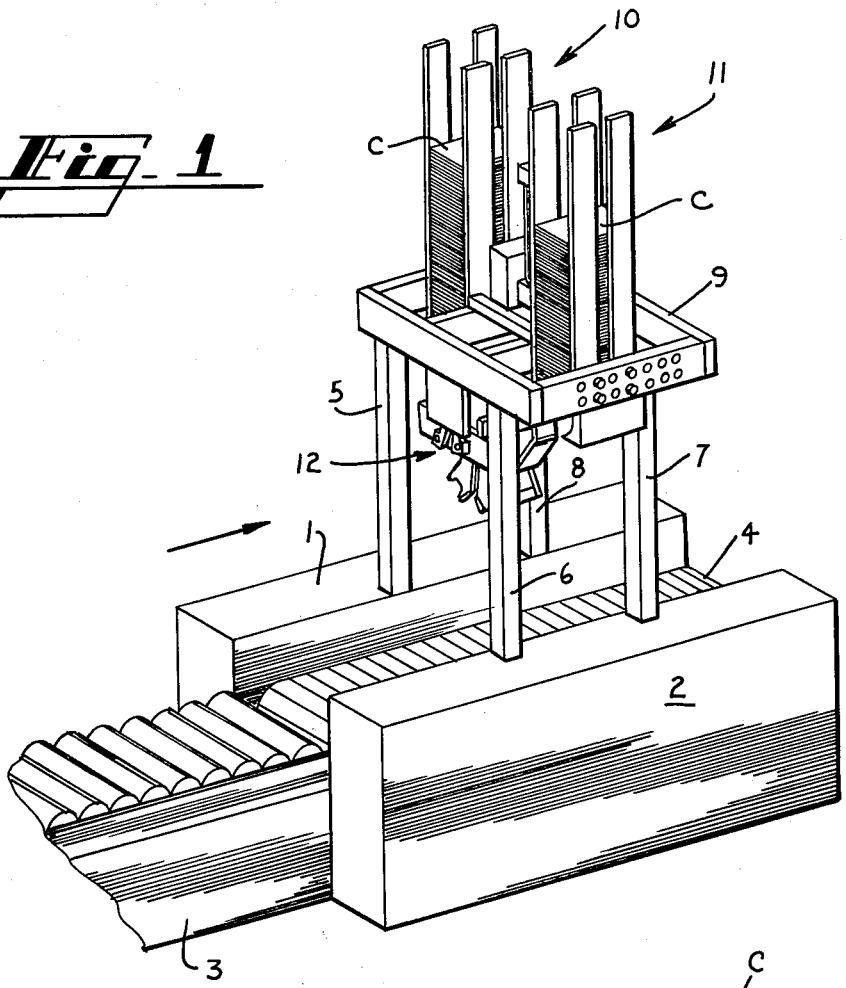
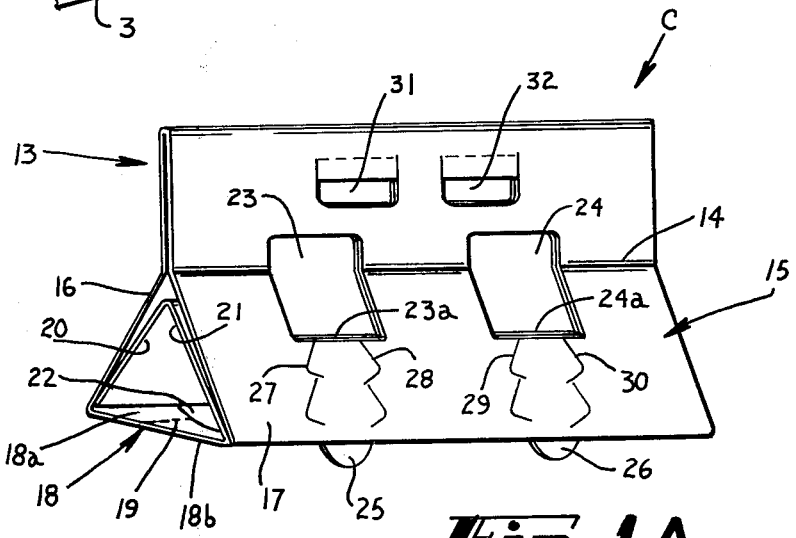
Fig. 1A

MACHINE FOR APPLYING AN ARTICLE CARRIER TO A PLURALITY OF BOTTLES

TECHNICAL FIELD

This invention relates to packaging of bottles and more particularly to a machine for applying a bottle carrier having apertures therein to a group of bottles so that the apertures in the carrier respectively envelope the bottle necks.

BACKGROUND ART

U.S. Pat. No. 3,859,773 issued Jan. 14, 1975 and owned by the assignee of this invention discloses a machine for applying carriers having apertures therein to a group of bottles, the carriers preferably being formed of yieldable plastic material. In U.S. Pat. No. 3,859,773, a vertically reciprocable plunger is disposed above a group of articles and is provided with a carrier holder mounted on the plunger by a lost motion relationship and the carriers are fed horizontally from a hopper into the holder which during downward movement of the plunger causes the carrier to settle into a position immediately above the group of articles from which position the carrier is driven onto the articles by the plunger.

DISCLOSURE OF THE INVENTION

According to this invention in one form, at least one carrier applicator member is pivotally mounted on a vertically reciprocable plunger means and is arranged to receive a carrier having apertures so that downward movement of the applicator member with the plunger drives the carrier onto the bottles to cause the apertures in the carrier respectively to envelope the necks of the bottles. Upon completion of a loading operation, the applicator member is swung about its pivotal mounting by cam means so as to cause the applicator member to disengage the carrier. According to a feature of the invention, a feeder arm is pivotally mounted on the plunger and is arranged to swing into engagement with a carton disposed in a hopper when the plunger is in its uppermost position following which swinging movement of the feeder arm deposits the carrier into the spaced jaws of the applicator member.

A carrier of the type to which the machine of this invention is particularly applicable is disclosed and claimed in U.S. Pat. No. 4,180,191 issued Dec. 25, 1979 and owned by the assignee of this invention.

BRIEF DESCRIPTION OF THE DRAWINGS

In the drawings FIG. 1 is an isometric overall view of a machine constructed according to the invention;

FIG. 1A is an isometric view of a set-up carrier of the type to which the machine of this invention is particularly applicable;

FIG. 9 is an enlarged detailed view of a cam mechanism used to rotate the applicator members following application of the carriers to two groups of bottles and which shows one applicator member in the position which it occupies during application of a carrier to a bottle group; and in which

BEST MODE FOR CARRYING OUT THE INVENTION

Figure 2:
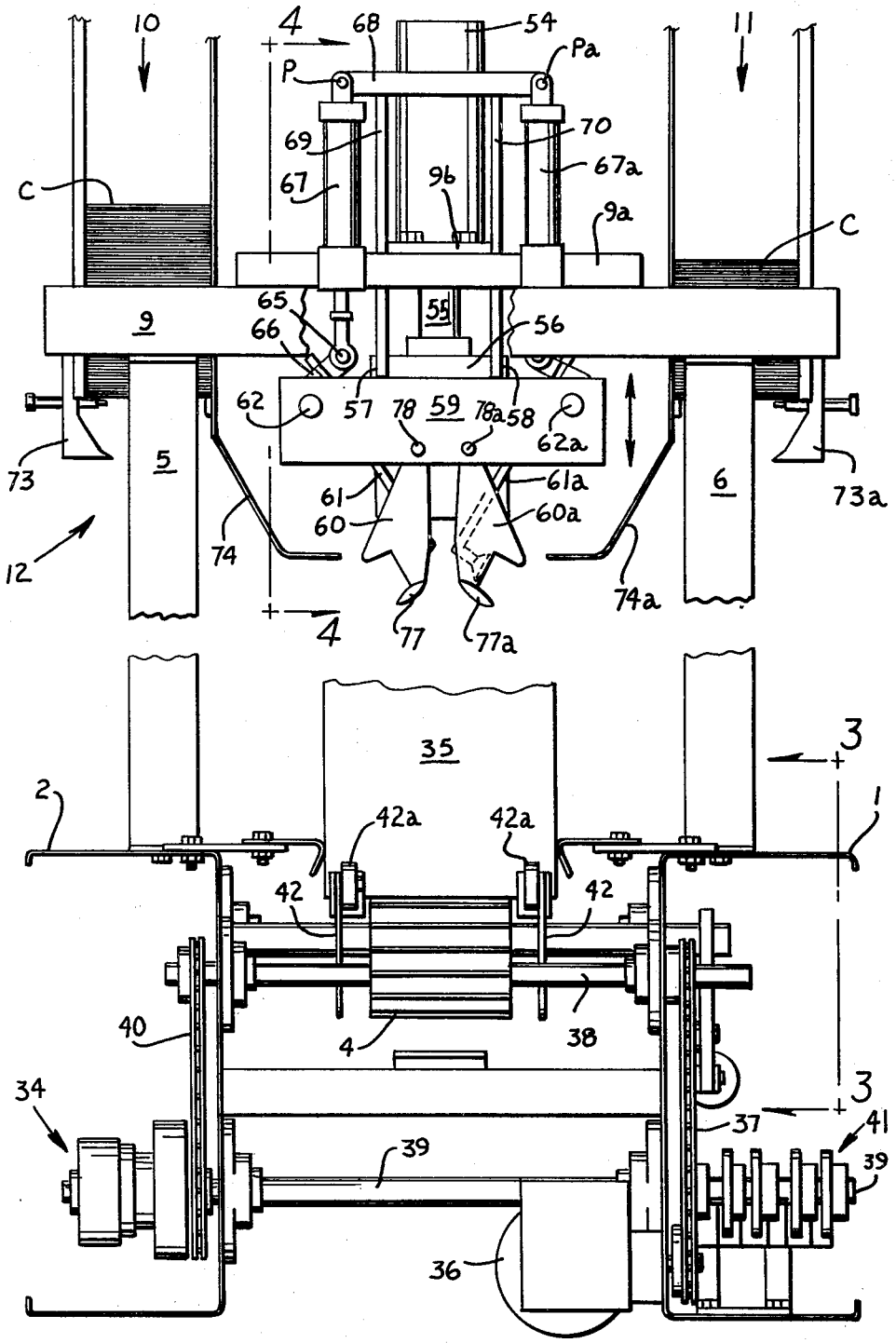
FIG. 2 is an end view of the machine shown in FIG. 1 with certain parts omitted for clarity.

In the drawings the numerals 1 and 2 designate housing structures disposed on either side of the mechanism and which serve as support means for the upper portions. The numeral 3 designates an infeed conveyor arranged to supply cartons having bottles therein onto the conveyor means 4 which constitutes an integral part of a machine constructed according to this invention. Support posts 5, 6, 7, and 8 are mounted on frame housings 1 and 2 and serve to support the generally rectangular frame structure 9 on which hoppers generally designated at 10 and 11 are mounted. Applicator mechanism supported by frame 9 is generally designated by the numeral 12. Cartons C are mounted in known fashion in the hoppers 10 and 11.

A carrier of the type to which the machine of this invention is particularly applicable is shown in FIG. 1A and includes a handle portion 13 which is foldably joined along its lower edge 14 to the bottle engaging portion generally designated at 15. Bottle engaging portion 15 includes a pair of inwardly tapered side walls 16 and 17 and a bottom wall 18 having a medial fold line 19. Supplementary side wall inner panels are designated by the numerals 20 and 21. Bottom wall 18 includes apertures such as that indicated at 22 and side walls 16, 17, 20, and 21 include apertures such as are indicated at 23 and 24. Pull tabs 25 and 26 are provided for severing side wall 15 along the severance slits designated at 27, 28, 29, and 30. Finger gripping apertures 31 and 32 are formed in handle 13.

As is more fully disclosed in the aforementioned U.S. Pat. No. 4,180,191, the carrier C as shown for example in FIG. 1A when in collapsed flat condition in a hopper is arranged with the bottom 18 collapsed due to outward folding of its panels **18*a* and 18*b* along the medial fold line 19. During feeding of a carrier from its hopper into an applicator member of this invention, the carrier is manipulated into set-up condition and then is applied to a group of bottles so as to cause the apertures in the bottom panel 18 respectively to envelope the necks of the bottles and so as to cause the bottle flanges respectively to rest on the lower edges such as 23*a* and 24*a* of apertures 23 and 24. During this operation the handle 13** is folded to one side into a substantially horizontal condition so as to permit stacking of carriers and their containers one atop another.

Figure 3:
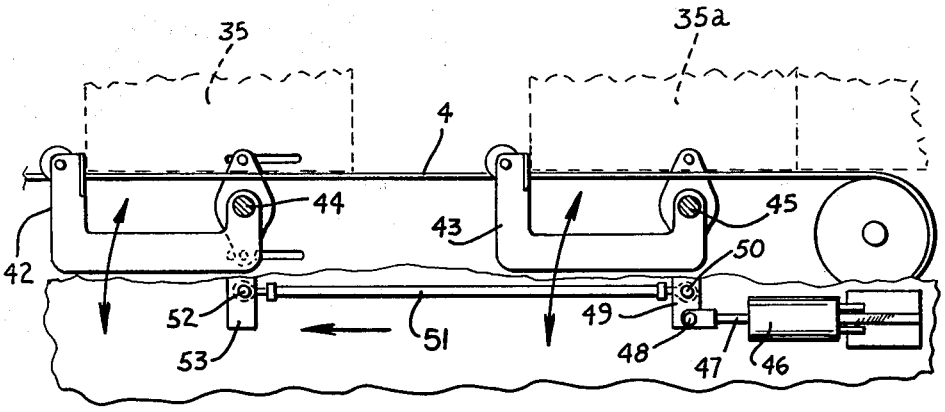
FIG. 3 is a side view of a part of the indexing mechanism for supplying containers having bottles therein to a loading station.

A container such as is indicated in FIG. 2 by the numeral 35 is supplied to the machine on conveyor 3 and is fed into the loading station by mechanism best shown in FIGS. 2 and 3. In FIG. 2 motor 36 is mounted on the frame 1 and drives belt 37 and shaft 38 which in turn imparts movement to conveyor 4. Conveyor 4 moves a container having bottles therein such as is indicated at 35 into a position which is sensed by phototube means not shown in the drawings but which is conventional. Such sensing means activates clutch 34 which is conventional to couple shaft 39 to shaft 38 via belts 40 so that the system of cams generally designated at 41 is caused to rotate when clutch 34 becomes engaged. Cams 41 control pneumatic devices which serve to operate the applicator structure 12 and which also serve to activate the positioning structure for case 35.

Positioning structure is shown in FIGS. 2 and 3 and includes stops 42 and 43. These stops are pivoted at shafts 44 and 45 respectively and are moved into their upper case engaging positions as shown in FIG. 3 by an air cylinder and piston 46 and its associated plunger 47 which is pivoted at 48 to link 49 fixedly secured to shaft 45 and which in turn is pivotally connected at 50 to reciprocable rod 51. Rod 51 is pivotally connected at 52 to link 53 which is fixedly connected to shaft 44. Thus if plunger 47 is in its extreme position toward the left, the stops 42 and 43 are in their up positions as shown in FIG. 3. If the air cylinder is operated so that rod 47 moves toward the right, the stops 42 and 43 swing downwardly in a counterclockwise direction about shafts 44 and 45 and the cases such as 35 and 35*a* may move on the conveyor 4. Container 35 and stop 42 are disposed at the loading station while container 35*a* is simply disposed in a holding position from which it will move to the loading station as determined by stop 42 after the bottles in carton 35 are loaded into carriers by the machine of this invention and after the container 35 moves out of the loading station.

For the purpose of withdrawing collapsed carriers from the hoppers 10 and 11 and for applying those carriers to the bottles disposed at the loading station in container 35, the applicator mechanism 12 is employed according to this invention and includes a cylinder 54 mounted on plate 9*a* by bolts 9*b* and having a plunger 55 which is vertically reciprocable in known manner. Secured to the lower end of plunger 55 is a head plate 56 which is mounted to cross struts 57 and 58 which in turn are secured as by welding or otherwise to the crosshead 59. Although not shown in the drawings it will be understood that a second crosshead 59 is disposed behind that shown in the drawings.

Figure 5:
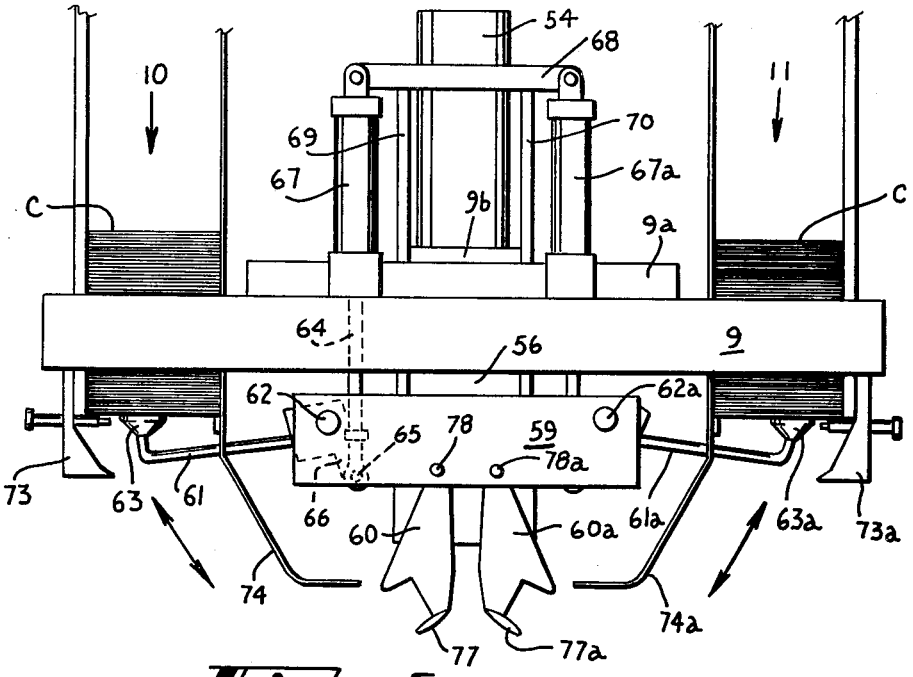
FIG. 5 is an end view of the machine showing the parts in the positions which they occupy when the plunger is in its uppermost position and with the feeder arms in contact respectively with the lowermost carriers in the two hoppers.

With the applicator mechanism disposed in its upper position as shown in FIGS. 2 and 5, the lowermost carrier C1 in hopper 10 is withdrawn from the hopper and supplied to the applicator member 60 by a feeder arm 61 pivotally mounted to crosshead 59 at pivot 62. A suction cup 63 is secured in known manner to feeder arm 61. In order to swing the feeder arm 61 about its pivot 62, a vertically reciprocable rod 64 is connected by pin 65 to the crank arm 66 of feeder arm 61. Reciprocatory motion is imparted to rod 64 by an air cylinder and piston 67 of known construction. The upper end of air cylinder and piston 67 is pivoted at P to a horizontally dipsosed support arm 68 which in turn is supported by vertical rods 69 and 70 the lower ends of which are secured by suitable means to the support rods 57 and 58 and in turn to the crosshead 59. The upper ends of rods 69 and 70 are secured to cross member 68 as by welding or other suitable means. Air cylinder 67 is thus fixed in position and movable with plunger 55 but is arranged to swing about its pivot P as may be required during the operation of the feeder arm 61 as it oscillates to and fro about its center of oscillation 62.

The collapsed carriers as disposed in hopper 10 are arranged with the handles 13 toward the right and with the side walls 16 down. As explained the bottom panels 18*a* and 18*b* are folded outwardly along medial fold line 19 and into flat face contacting relation.

Figure 6:
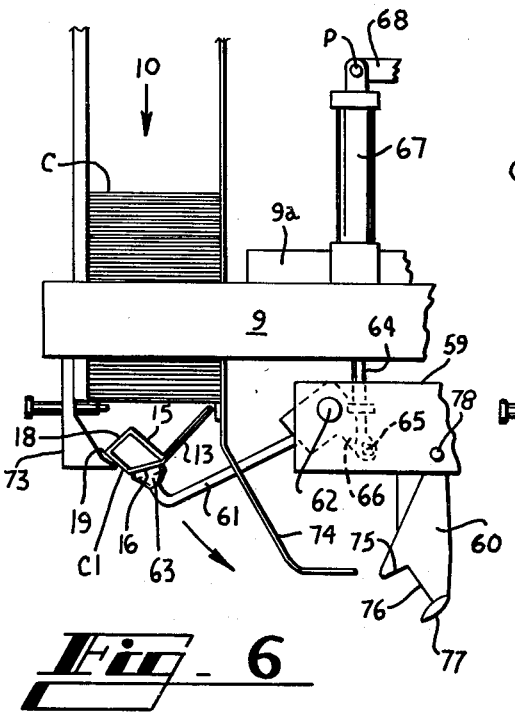
FIG. 6 is a view similar to FIG. 5 and which shows the left hand portion of the machine during a feeding operation after a carton is withdrawn from its hopper but before the carton is applied to the applicator member.
Figure 7:
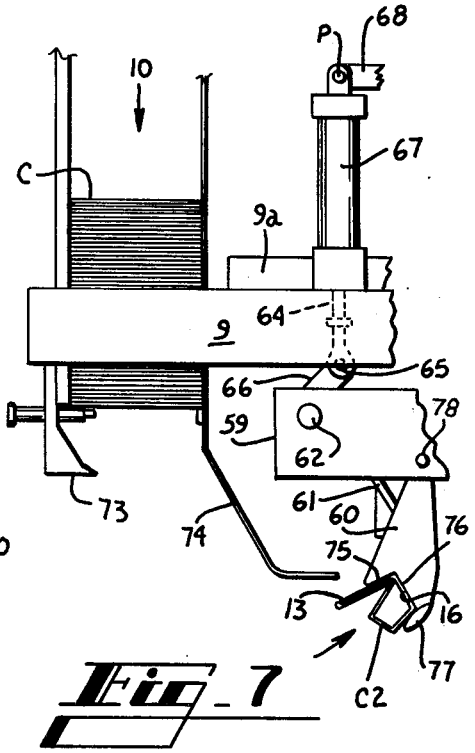
FIG. 7 is a view similar to FIG. 6 and shows the carton after being applied to the applicator member.
Figure 8:
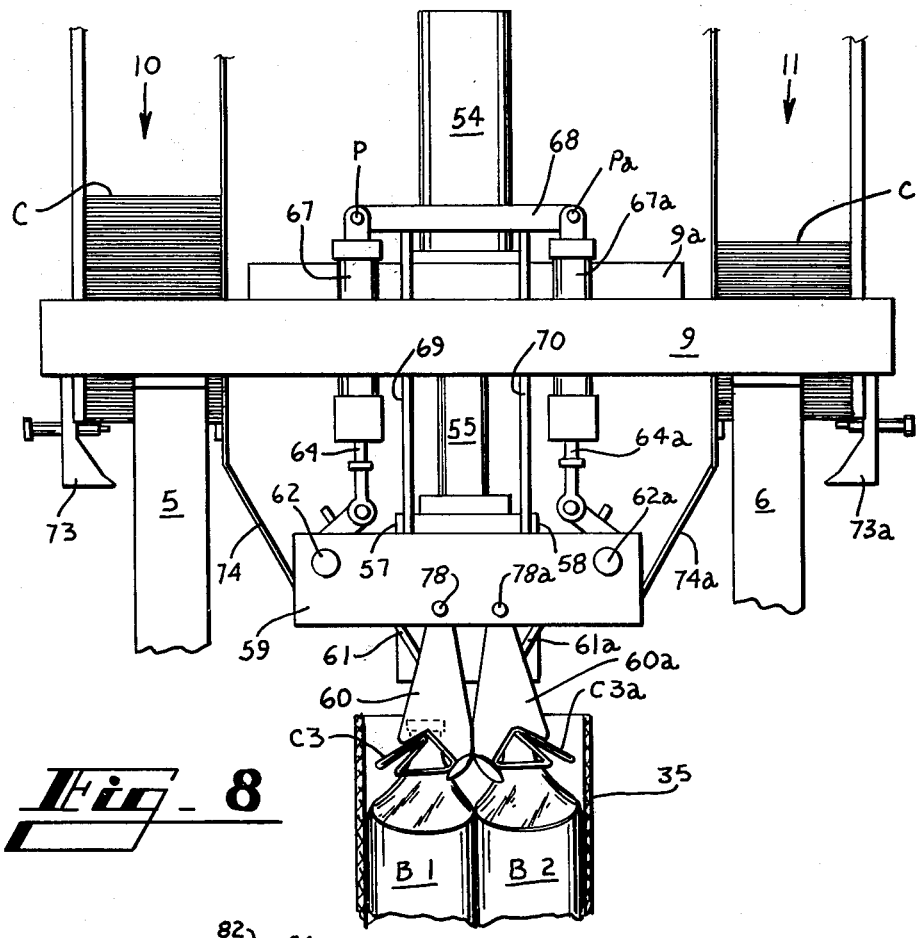
FIG. 8 is a view similar to FIG. 5 but which shows the plunger mechanism and associated parts in their lowermost positions at which a pair of cartons are applied respectively to two rows of bottles.

A carrier is partially set up as the parts move from the positions shown in FIG. 5 to those shown in FIG. 6. During this movement, the abutment 73 engages the bottom wall 18 and initiates a setting up operation as indicated at position C1. Subsequently the plows 74 engage the handle 13 and swing it to a position such as is indicated in FIG. 6. When the feeder arm 61 reaches the position indicated in FIG. 7 the carrier occupies the position indicated at C2 between the jaws 75 and 76 of the applicator member 60. As is apparent in FIG. 7 the handle 13 is in engagement with jaw 75 while side wall 16 is in engagement with jaw 76. With the parts disposed in the positions represented in FIG. 7, downward movement of the plunger structure including the crosshead 59 and the applicator member 60 commences. When the apertures formed in the bottom wall 18 of the carrier envelope the necks of the bottles such as B1 disposed within the container 35 as shown in FIG. 8, the carrier represented at C3 is in its fully mounted position and with the handle 13 folded downwardly. With the handle folded downwardly of course the cover of the container 35 may be closed or if desired another container such as 35 may be stacked atop container 35 without interference by the handle.

Figure 9:
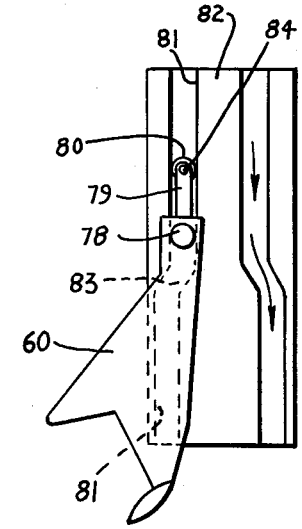
Figure 10:
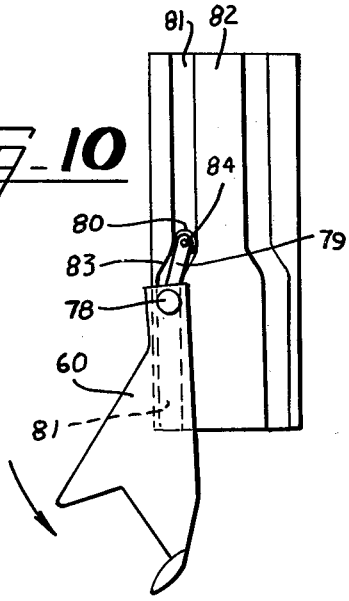
FIG. 10 is similar to FIG. 9 and shows the applicator in the position which it occupies following application of a carrier to a group of bottles.

With the carrier such as C3 mounted on the bottles such as B1 as shown in FIG. 8, it is then necessary to disengage the applicator 60 from the bottles B1. In order to effect this end and so as to cause the tip portion 77 of applicator member 60 to move from underneath the carrier 63 and thus to disengage the carrier, it is necessary to swing the applicator member 60 in a clockwise direction about its pivotal mounting 78. To this end the structure schematically represented in FIGS. 9 and 10 is employed. The pivotal mounting 78 is in reality a shaft which at its far end includes an integral crank 79 and a cam roller 80 which is arranged to ride in cam slot 81 formed in fixed plate 82 mounted to the frame of the machine in back of the vertically reciprocal parts of the plunger mechanism. As is apparent, cam slot 81 at its upper end is straight and at its midportion is curved as indicated at 83 so that as cam roller 80 moves upwardly in cam slot 81 the crank arm 79 swings toward the right or in a clockwise direction about the center 78. This clockwise movement of crank 79 causes applicator 60 to swing in a clockwise direction about its center 78 and in a plane transverse to a row of bottles thus causing the tip 77 to disengage the lower right hand corner of carton C3 which represents the junction between side wall 16 and bottom wall 18. This oscillatory rocking movement of applicator member 60 causes the projecting tip 77 to move into a clearing relation relative to carton C3 and allows the plunger to move upwardly. Upon completion of this upward stroke, a loading operation may be repeated.

Figure 4:
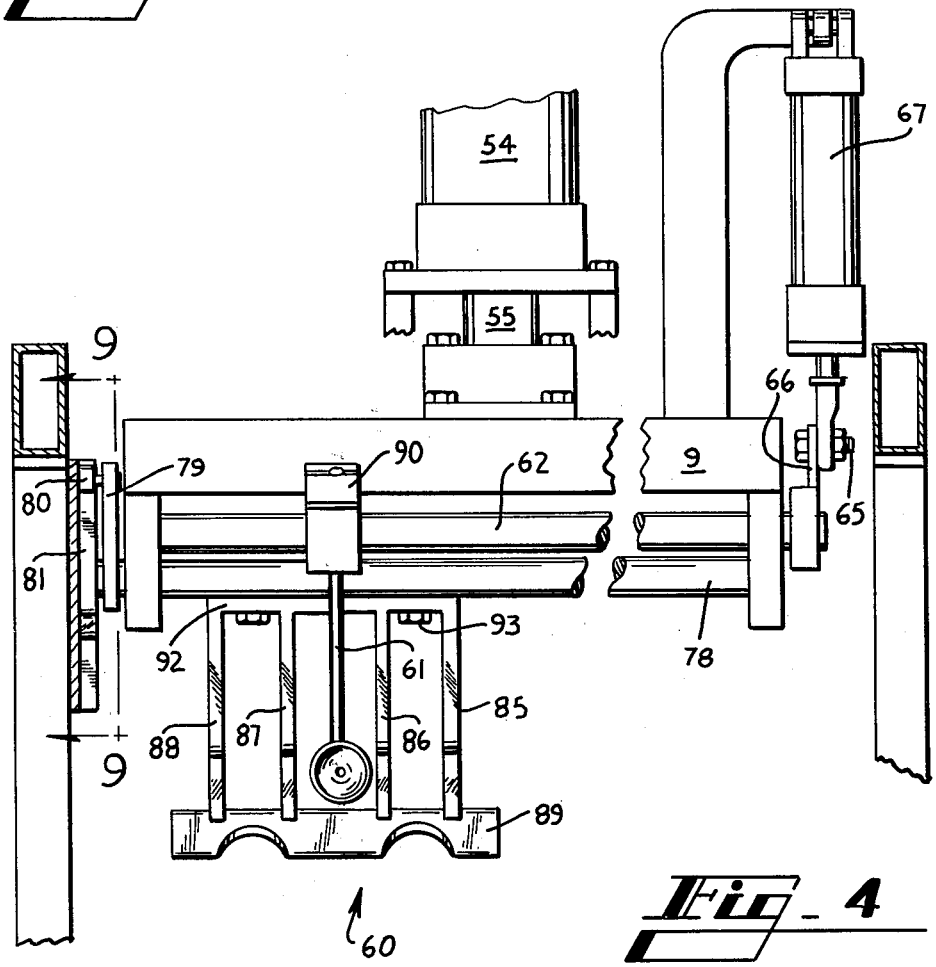
FIG. 4 is an enlarged side view of a part of the applicator mechanism.

As is best shown in FIG. 4, the applicator 60 includes a plurality of applicator elements 85–88 which are interconnected at their lower ends by the cross member 89. Also from FIG. 4 it is apparent that the feeder arm 61 swings between applicator elements 86 and 87 when depositing a carton between the jaws of the applicator elements. Also it is apparent that the arm 61 is clamped by clamping means 90 to its pivot shaft 62 and that applicator elements 85–88 are secured to pivot shaft 78 by cross member 92 and bolts 93.

The applicator member 60 and parts associated therewith have been described together with the operation of carriers withdrawn from hopper 10 by feeder arm 61. It will be understood that operation of applicator 60*a* is identical with that of applicator 60 and that the parts associated with hopper 11 and with applicator member 60*a* are given the same numerals as those described above in connection with applicator 60 and feeder 61 with the addition of the subscript "a".

INDUSTRIAL APPLICABILITY

While the carrier as shown in FIG. 1A and in the aforementioned U.S. patent application Ser. No. 926,858 can be applied to groups of bottles by hand, such application is not commercially feasible. Thus the machine of this invention provides an efficient high speed mechanism for loading bottles into top gripping type carriers in an efficient and economical manner.

The embodiments of the invention in which an exclusive property or privilege is claimed are defined as follows:

1. A machine for applying an article carrier having apertures therein to a row of bottles to cause the neck of each bottle to be enveloped by a carrier aperture, said machine comprising conveyor means (4) for moving a group of bottles arranged in side by side relationship into a loading station, vertically reciprocable plunger means (55,59) disposed above said loading station, at least one applicator member (60) pivotally mounted on said plunger means and disposed to receive carriers in sequence and movable downwardly to cause the carrier apertures to envelope the necks of bottles at said loading station, and cam means (80,81) arranged to swing said applicator member about its pivotal mounting in a plane transverse to said row of bottles following application of a carrier to a group of bottles so as to cause said applicator to disengage the carrier.

2. A machine according to claim 1 wherein a fixedly mounted hopper (10) is arranged to hold a plurality of collapsed carriers and wherein a carrier feeder arm (61) is pivotally mounted on said plunger means and wherein operating means (67) is mounted on said plunger means and arranged to swing said feeder arm about its pivotal mounting to cause the swing end of said feeder arm to engage and withdraw a carrier from said hopper and to deposit the carrier on said applicator member (60).

3. A machine according to claim 2 wherein said applicator member (60) comprises a plurality of applicator elements (85–88) and wherein said feeder arm (61) is arranged to swing between adjacent applicator elements during carrier feeding and return movement of said feeder arm.

4. A machine according to claim 2 wherein said feeder arm (61) includes a suction cup (63) for engaging and moving the carrier to said applicator member (60) and wherein suction pressure is maintained until the carrier is secured to the bottle group.

5. A machine according to claim 1 wherein said applicator member (60) comprises a pair of jaws (75,76) for receiving the carrier therebetween.

6. A machine according to claim 2 wherein said hopper (10) is fixed in position and disposed adjacent said plunger means (55,59) when said plunger means occupies its upper limit of travel and wherein said feeder arm (61) engages and withdraws a carrier when said plunger means is in its upper position.

7. A machine according to claim 5 wherein the carrier comprises a bottle engaging portion (15) having a pair of inwardly tapered side walls (16,17) joined together at the top edges and wherein one of said jaws (76) engages one of the carrier side walls (16).

8. A machine according to claim 7 wherein said one jaw (76) includes an inwardly projecting tip portion (77).

9. A machine according to claim 8 wherein said inwardly projecting tip portion (77) engages the bottom edge (22) of said one side wall.

10. A machine according to claim 9 wherein swinging movement of said applicator member (60) about its pivotal mounting (78) causes said one jaw (76) and its inwardly projecting tip portion (77) to swing away from said one side wall (16).

11. A machine according to claim 1 wherein the group of bottles comprises two parallel rows of bottles and wherein a pair of applicator members (60,60*a*) are pivotally mounted on said plunger means (55,59) and arranged to apply carriers to said two rows of bottles respectively and wherein said cam means (80,81) is arranged to swing both of said applicator members about their pivotal mountings (78,78*a*).

12. A machine according to claim 11 wherein said applicator members (60,60*a*) swing in opposite directions to disengage the rows of bottles respectively.

13. A machine according to claim 1 wherein said applicator member (60) comprises a plurality of applicator elements (85–88) arranged in pairs (85,86)(87,88) and with the elements of each pair disposed on opposite sides of the vertical axis of a bottle when disposed at said loading stations.

14. A machine for applying an article carrier having a bottle engaging portion with apertures therein to a plurality of bottles to cause the neck of each bottle to be enveloped by a carrier aperture and said carrier having a handle portion (13) foldably joined to said bottle engaging portion, said machine comprising conveyor means (4) for moving a group of bottles arranged in side by side relationship into a loading station, vertically reciprocable plunger means (55,59) disposed above said loading station, at least one applicator member (60) pivotally mounted on said plunger means and disposed to receive carriers in sequence and movable downwardly to cause the carrier apertures to envelope the necks of bottles at said loading station, cam means (80,81) arranged to swing said applicator member about its pivotal mounting following application of a carrier to a group of bottles so as to cause said applicator to disengage the carrier, a fixedly mounted hopper (10) arranged to hold a plurality of collapsed carriers, a carrier feeder arm (61) pivotally mounted on said plunger means, operating means (67) mounted on said plunger means and arranged to swing said feeder arm about its pivotal mounting to cause the swing end of said feeder arm to engage and withdraw a carrier from said hopper and to deposit the carrier on said applicator member (60), and a handle folding plow (74) disposed between said hopper and said plunger means for engaging and folding said handle portion (13) relative to said bottle engaging portion (15) in coordination with feeding of the carton from said hopper (10) to said applicator member (60).

15. A machine for applying an article carrier having a bottle engaging portion with apertures therein to a plurality of bottles to cause the neck of each bottle to be enveloped by a carrier aperture and said carrier having a handle portion (13) foldably joined to said bottle engaging portion, said machine comprising conveyor means (4) for moving a group of bottles arranged in side by side relationship into a loading station, vertically reciprocable plunger means (55,59) disposed above said loading station, at least one applicator member (60) having a pair of jaws (75,76) pivotally mounted on said plunger means and disposed to receive carriers in sequence and movable downwardly to cause the carrier apertures to envelope the necks of bottles at said loading station, one of said jaws (76) being engageable with said bottle engaging portion (15) and the other of said jaws (75) being engageable with said handle portion (13) during application of the carrier to a group of bottles, and cam means (80,81) arranged to swing said applicator member about its pivotal mounting following application of a carrier to a group of bottles so as to cause said applicator to disengage the carrier.

* * * * *